US010409205B2

(12) United States Patent
Konishi

(10) Patent No.: US 10,409,205 B2
(45) Date of Patent: Sep. 10, 2019

(54) IMAGE FORMING APPARATUS COMPRISING A MOVABLE COOLING DUCT BETWEEN THE DRUM UNIT AND THE FIXING UNIT

(71) Applicant: KYOCERA Document Solutions Inc., Osaka (JP)

(72) Inventor: Hirohito Konishi, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/945,151

(22) Filed: Apr. 4, 2018

(65) Prior Publication Data

US 2018/0314197 A1 Nov. 1, 2018

(30) Foreign Application Priority Data

Apr. 28, 2017 (JP) ..... 2017-090086

(51) Int. Cl.
*G03G 15/20* (2006.01)
*G03G 21/20* (2006.01)
*G03G 21/00* (2006.01)

(52) U.S. Cl.
CPC ..... *G03G 15/2039* (2013.01); *G03G 15/2017* (2013.01); *G03G 21/206* (2013.01);
(Continued)

(58) Field of Classification Search
CPC ..... G03G 15/2032; G03G 15/205; G03G 15/206; G03G 21/0011; G03G 21/0058; G03G 21/206
See application file for complete search history.

(56) References Cited

U.S. PATENT DOCUMENTS

2005/0078976 A1* 4/2005 Deguchi ..... G03G 21/206 399/92
2005/0238379 A1* 10/2005 Ogane ..... G03G 15/0258 399/92

(Continued)

FOREIGN PATENT DOCUMENTS

JP 59033516 A * 2/1984 ..... G03G 21/206
JP H10-307525 A 11/1998

(Continued)

*Primary Examiner* — Walter L Lindsay, Jr.
*Assistant Examiner* — Arlene Heredia
(74) *Attorney, Agent, or Firm* — IP Business Solutions, LLC

(57) ABSTRACT

An image forming apparatus includes: a drum unit having an image carrier carrying a toner image; a fixing unit having a heating member and pressure member forming a fixing nip part with the heating member and fixing the toner image on a recording medium at the fixing nip part; a cooling duct provided between the drum unit and the fixing unit preventing heat transfer from the fixing unit to the drum unit; and a cooling fan causing the air to flow to the cooling duct. The cooling duct is a movable duct being changeable to a first state in which the cooling duct is unopen towards the fixing unit and a second state in which the cooling duct is open towards the fixing unit. The cooling duct changes to the first state during image formation by the drum unit and changes to the second state after the image formation.

6 Claims, 8 Drawing Sheets

(52) U.S. Cl.
CPC ..... *G03G 15/2032* (2013.01); *G03G 21/0011* (2013.01); *G03G 21/0058* (2013.01)

(56) References Cited

U.S. PATENT DOCUMENTS

| | | | | |
|---|---|---|---|---|
| 2011/0097123 | A1* | 4/2011 | Eiki | G03G 21/0011 399/349 |
| 2011/0142507 | A1* | 6/2011 | Sasaki | G03G 15/2032 399/331 |
| 2013/0051831 | A1* | 2/2013 | Shinagawa | G03G 15/2032 399/69 |
| 2013/0094877 | A1* | 4/2013 | Tsuji | G03G 15/657 399/92 |
| 2017/0090417 | A1* | 3/2017 | Yoshioka | G03G 21/206 |
| 2017/0261914 | A1* | 9/2017 | Aizawa | G03G 15/6576 |

FOREIGN PATENT DOCUMENTS

| | | | | |
|---|---|---|---|---|
| JP | H11-194569 | A | 7/1999 | |
| JP | 2001-013855 | A | 1/2001 | |
| JP | 2015219452 | A * | 12/2015 | G03G 15/205 |

* cited by examiner

IMAGE FORMING APPARATUS COMPRISING A MOVABLE COOLING DUCT BETWEEN THE DRUM UNIT AND THE FIXING UNIT

INCORPORATION BY REFERENCE

This application claims priority to Japanese Patent Application No. 2017-090086 filed on 28 Apr. 2017, the entire contents of which are incorporated by reference herein.

BACKGROUND

This disclosure relates to an image forming apparatus and more specifically to a technology of suppressing a temperature increase of a drum unit.

A typical image forming apparatus includes: a photosensitive drum serving as an image carrier; a charging device which charges the photosensitive drum; an exposure device which irradiates a surface of the charged photosensitive drum with laser light based on a document to thereby form a latent image of the document on the surface of the photosensitive drum; a developing device which visualizes the latent image with a toner; a transfer roller which transfers, onto recording paper, a toner image formed through the visualization; a fixing device which fixes the transferred toner image on the recording paper; and a cleaning device which removes the toner remaining on the surface of the photosensitive drum.

Due to promoted downsizing of image forming apparatuses in recent years, a space between units in the apparatus has become narrower, and a drum unit having a photosensitive drum may be arranged near a fixing unit forming a fixing device. Transfer of a fixing heat generated in the fixing device to the drum unit may has an adverse effect on the drum unit. For example, a drum unit having a cleaning device is at a risk that a temperature increase of the cleaning device solidifies the toner, resulting in failure to adequately collect the toner.

To solve such a problem, known is, for example, a technology of providing a cooling duct between the drum unit and the fixing unit and causing cooling wind to flow from a cooling fan into the cooling duct to thereby achieve heat insulation between the drum unit and the fixing unit and prevent heat transfer from the fixing unit to the drum unit.

SUMMARY

As one aspect of this disclosure, a technology obtained by further improving the aforementioned technology will be suggested.

An image forming apparatus according to one aspect of this disclosure includes: a drum unit, a fixing unit, a cooling duct, and a cooling fan. The drum unit has an image carrier carrying a toner image. The fixing unit has a heating member and a pressure member forming a fixing nip part with the heating member, and fixes the toner image on a recording medium at the fixing nip part. The cooling duct is provided between the drum unit and the fixing unit for preventing heat transfer from the fixing unit to the drum unit. The cooling fan causes the air to flow to the cooling duct.

The cooling duct is a movable duct being capable of changing to a first state in which the cooling duct is not open towards the fixing unit and a second state in which the cooling duct is open towards the fixing unit, and the cooling duct changes to the first state during image formation processing performed by the drum unit and changes to the second state after the image formation processing.

DETAILED DESCRIPTION

Figure 1:
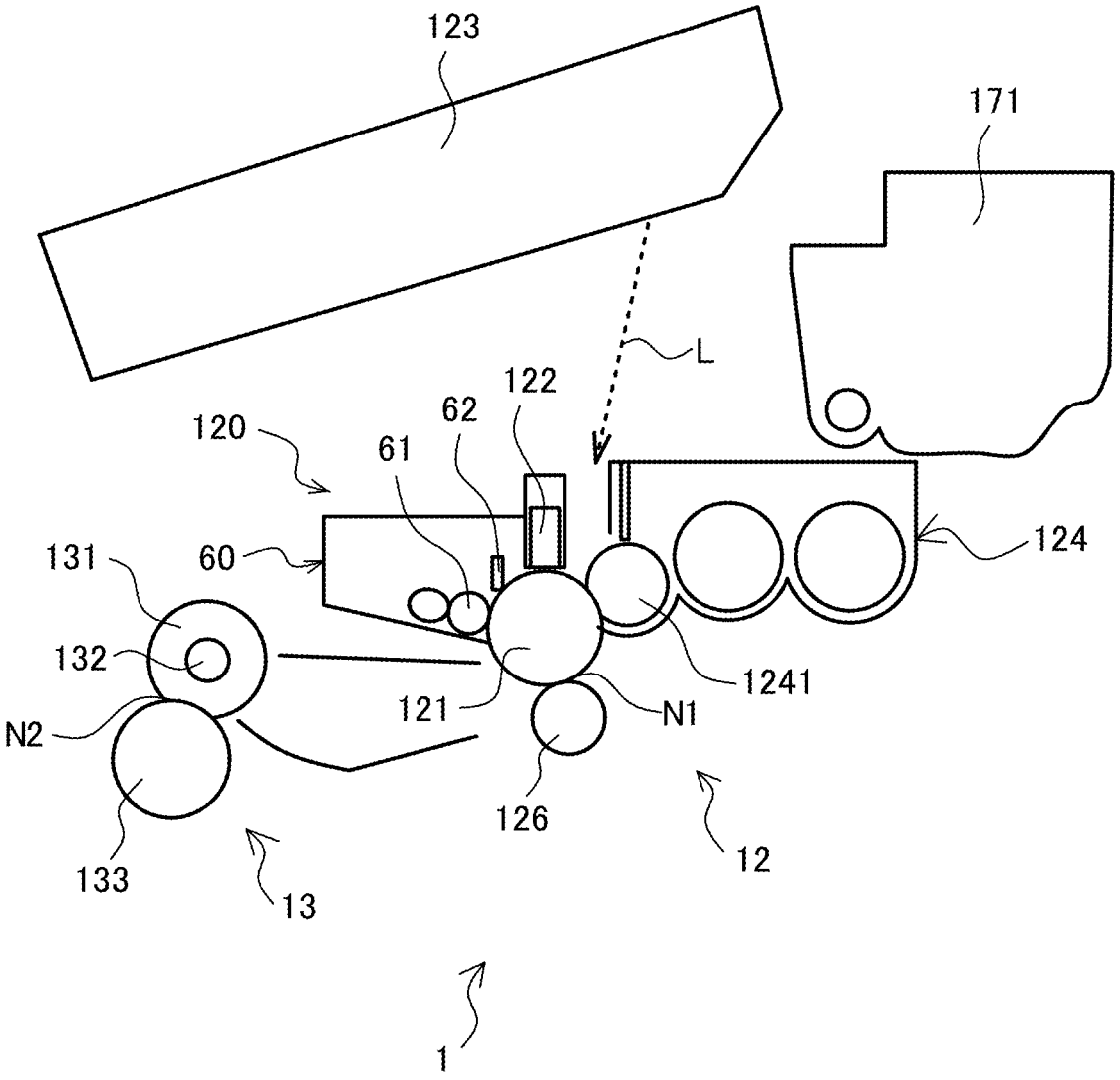
FIG. 1 is a sectional view schematically illustrating an image formation section and surrounding parts thereof in an image forming apparatus according to a first embodiment of this disclosure.

Hereinafter, an image forming apparatus according to one embodiment of this disclosure will be described with reference to the drawings. FIG. 1 is a sectional view schematically illustrating an image formation section and surrounding parts thereof in an image forming apparatus according to a first embodiment of this disclosure. The image forming apparatus 1 is a multifunction peripheral which combines together a plurality of functions such as, for example, a copy function, a printer function, a scanner function, and a facsimile function.

The image formation section 12 forms a toner image on recording paper serving as a recording medium, and includes: a photosensitive drum 121, a charging device 122, an exposure device 123, a developing device 124, a transfer roller 126, a cleaning device 60, and a toner container 171. The photosensitive drum 121, the charging device 122, and the cleaning device 60 are unitized, forming a drum unit 120.

The photosensitive drum 121 is an image carrier, which is formed in a manner such as to be rotatable around a rotation axis and which carries a toner image on a surface thereof. The charging device 122 charges the surface of the photosensitive drum 121. Based on image data transmitted from an external device (for example, a personal computer), the exposure device 123 irradiates laser light L to thereby form a latent image on the surface of the photosensitive drum 121.

The developing device 124 has a developing roller 1241, and visualizes, with a toner, the latent image formed on the surface of the photosensitive drum 121. The transfer roller 126 forms a transfer nip part N1 with the photosensitive drum 121, and transfers the toner image onto the recording paper.

The cleaning device 60 includes a cleaning roller 61 and a cleaning blade 62. The cleaning roller 61 and the cleaning blade 62 make contact with the surface of the photosensitive drum 121 and removes the toner and an adhesive agent remaining on the surface of the photosensitive drum 121 to clean the surface of the photosensitive drum 121.

A fixing device 13 fixes the toner image on the recording paper through thermocompression, and includes: a heating roller 131 which has a heat lamp 132 built therein as a heat source; and a pressure roller 133. The heating roller 131 and the pressure roller 133 form a pair, so that when the recording paper is conveyed while sandwiched at a fixing nip part N2 formed by the heating roller 131 and the pressure roller 133, the non-fixed toner image is fused by a heat of the heat lamp 132 and is fixed onto the recording paper with a pressure of the heating roller 131 and the pressure roller 133. Note that the heating roller 131 and the pressure roller 133 are one example of a heating member and one example of a pressure member, respectively, in the scope of the claims.

Figure 2:
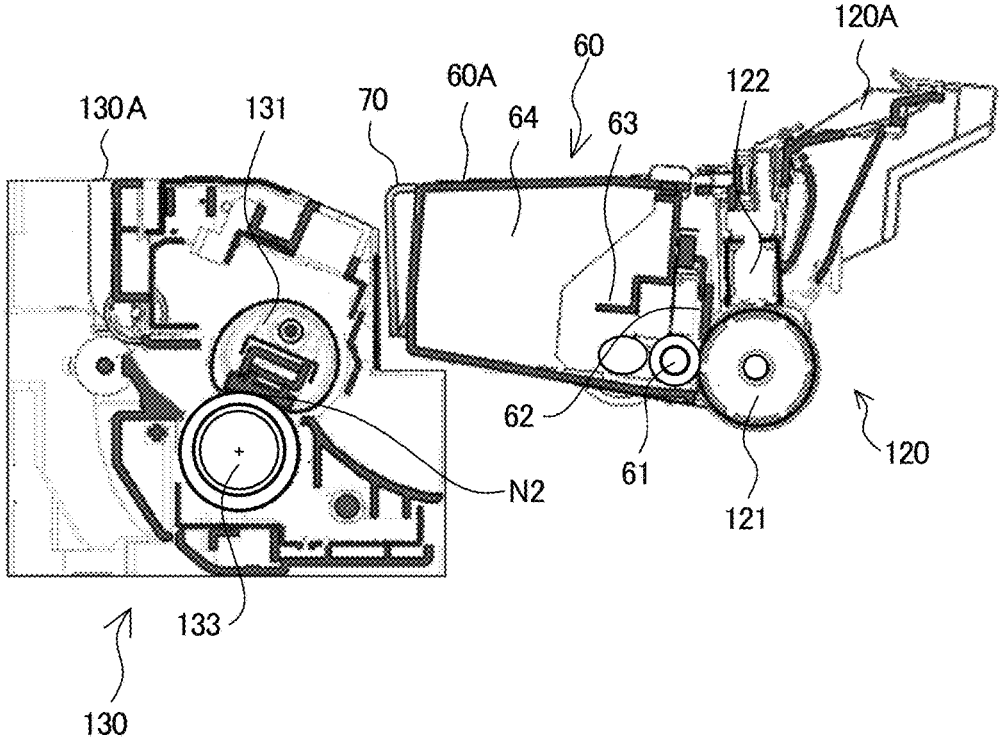
FIG. 2 is a sectional view schematically illustrating a drum unit and surrounding parts thereof.

FIG. 2 is a sectional view schematically illustrating the drum unit 120 and surrounding parts thereof. The drum unit 120 has the photosensitive drum 121, the charging device 122, and the cleaning device 60 which are integrally held by a drum housing 120A.

A cleaning housing 60A of the cleaning device 60 forms part of the drum housing 120A. Provided inside of the cleaning housing 60A is a partitioning wall 63 and formed inside of the cleaning housing 60A is a waste toner storage section 64 which stores the toner removed from the surface of the photosensitive drum 121 by the cleaning roller 61 and the cleaning blade 62.

A fixing unit 130 has the heating roller 131 and the pressure roller 133 integrally held by a fixing housing 130A. Note that the fixing unit 130 includes a pressing and separating mechanism 140 (not illustrated in FIG. 2 and see FIGS. 4 and 5) which presses and separates the heating roller 131 against and from the pressure roller 133, and this pressing and separating mechanism 140 will be described in detail later on.

Provided between the drum unit 120 and the fixing unit 130 is a cooling duct 70 for preventing heat transfer from the fixing unit 130 to the drum unit 120. The cooling duct 70 is provided on an outer wall of the cleaning housing 60A. The cooling duct 70 is a movable duct, which changes between a first state in which the cooling duct 70 is not open towards the fixing unit 130 and a second state in which the cooling duct 70 is open towards the fixing unit 130. Note that the outer wall part of the cleaning housing 60A also serves as part of the cooling duct 70.

Figure 3A:
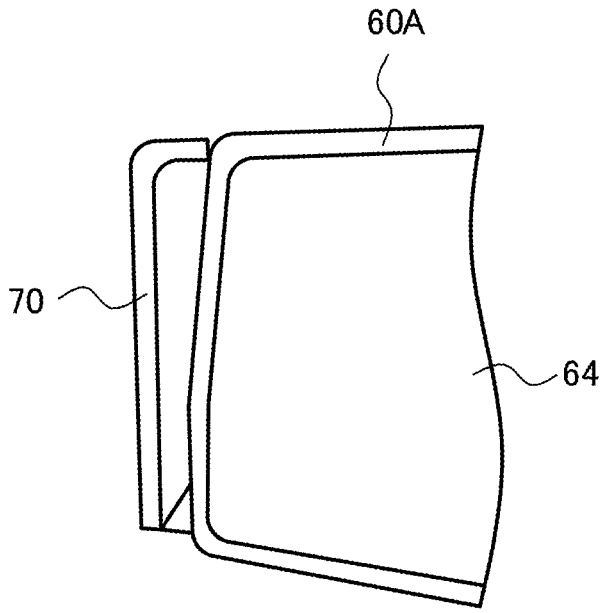
FIG. 3A is a view illustrating a first state in which a cooling duct is not open towards a fixing unit.
Figure 3B:
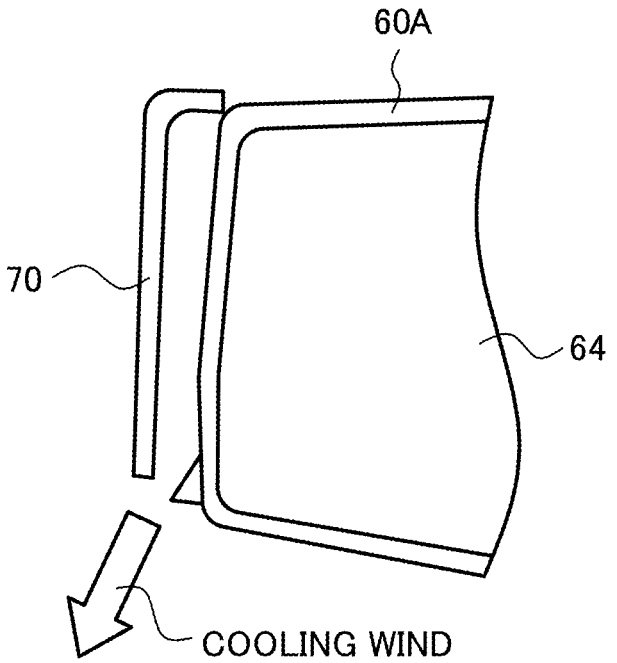
FIG. 3B is a view illustrating a second state in which the cooling duct is pushed upward to open towards the fixing unit.

Operation of the cooling duct 70 will be described. FIG. 3A illustrates the first state in which the cooling duct 70 is not open towards the fixing unit 130. FIG. 3B illustrates the second state in which the cooling duct 70 is pushed upward to open towards the fixing unit 130. Note that a moving mechanism of the cooling duct 70 will be described later on.

Figure 4:
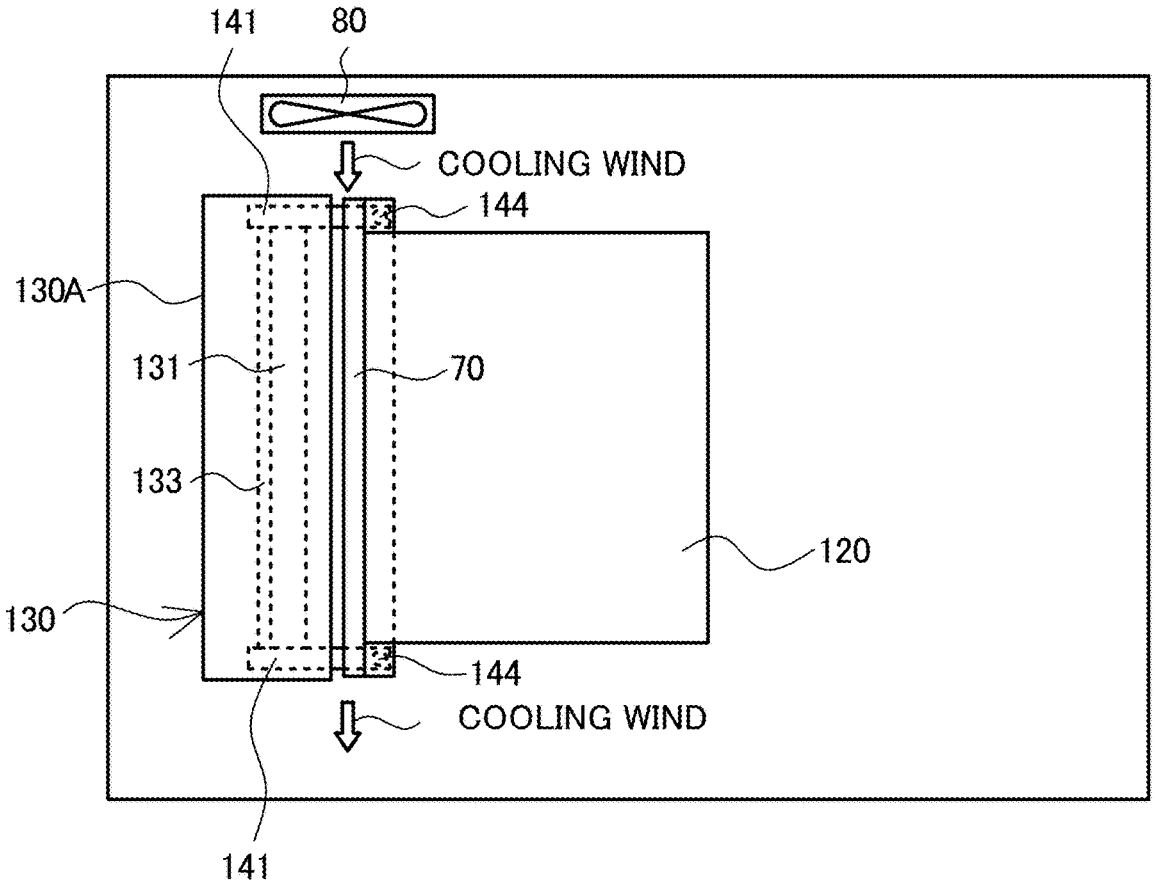
FIG. 4 is a plan view schematically illustrating the drum unit and surrounding parts thereof.
Figure 5A:
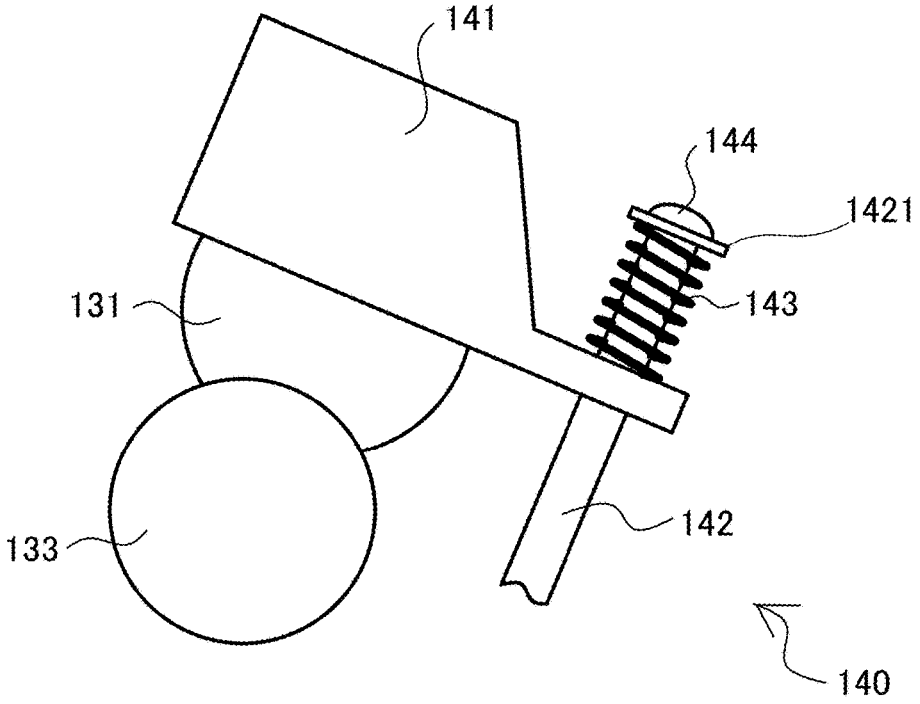
FIGS. 5A and 5B are side views schematically illustrating a mechanism of pressing and separating a heating roller against and from a pressure roller.
Figure 5B:
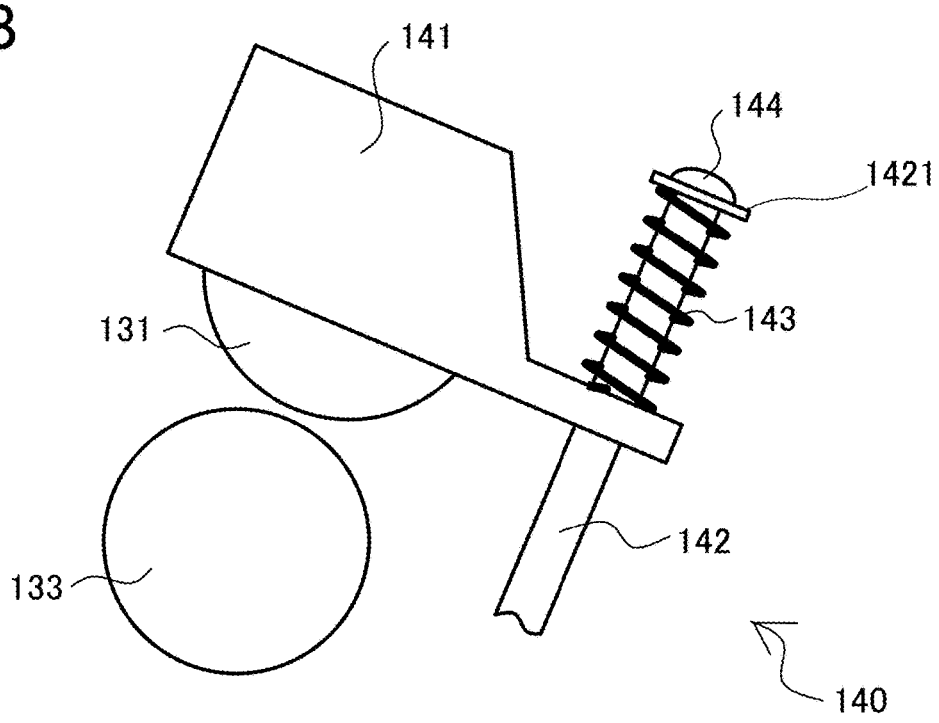

FIG. 4 is a plan view schematically illustrating the drum unit 120 and surrounding parts thereof. FIGS. 5A and 5B are side views schematically illustrating the pressing and separating mechanism 140. FIG. 5A illustrates a state in which the heating roller 131 is pressed against the pressure roller 133. FIG. 5B illustrates a state in which the heating roller 131 is separated from the pressure roller 133.

At a position located on a line extended longitudinally of the cooling duct 70 in FIG. 4, a cooling fan 80 is arranged oppositely to a side end part of the cooling duct 70. Activation of the cooling fan 80 permits cooling wind to flow longitudinally in the cooling duct 70. This flow of the cooling wind blocks heat exchange between the drum unit 120 and the fixing unit 130. Consequently, the heat transfer from the fixing unit 130 to the drum unit 120 is prevented.

The pressing and separating mechanism 140 which presses and separates the heating roller 131 against and from the pressure roller 133 includes: a pair of oscillation holders 141, a pair of towing shafts 142, a pair of springs 143, and a pair of end parts 144. The oscillation holder 141 supports the heating roller 131. The oscillation holder 141 is supported by the towing shaft 142. Formed at the oscillation holder 141 in a manner such as to penetrate therethrough in a thickness direction is a hole part of a diameter equal to or slightly larger than that of the towing shaft 142. The towing shaft 142 penetrates through this hole part in a movable manner.

The towing shaft 142 is a shaft of a cylindrical shape which extends in a manner such as to project upward. The spring 143 is a coiled push spring which covers circumference of the towing shaft 142. The towing shaft 142 penetrate through an inside of the spring 143 formed into a spiral shape. The spring 143 is provided, under a state where the towing shaft 142 penetrates through the inside of the spring 143, between an armor part 1421 of the towing shaft 142 and the oscillation holder 141. That is, the spring 143 has one end part locked by the armor part 1421 and another end part locked by the oscillation holder 141. A pressing force of the spring 143 against the oscillation holder 141 adjusts the pressing of the heating roller 131 against the pressure roller 133. The armor part 1421 is formed in a manner such as to radially project from a circumferential surface part of the towing shaft 142.

The towing shaft 142 is coupled to a motor, not illustrated, via an eccentric cam (to be described later on) so that the towing shaft 142 is pulled towards the pressure roller 133 (downward in FIG. 5A) and pushed down towards the pressure roller 133 (downward in FIG. 5A) by driving of the motor or by a solenoid. As a result of pulling the towing shaft 142 downward, the armor part 1421 presses the spring 143, compressing the spring 143 between the armor part 1421 and the oscillation holder 141. Consequently, the heating roller 131 presses the pressure roller 133 as illustrated in FIG. 5A. On the other hand, as a result of pressing the towing shaft 142 upward, the aforementioned compression of the spring 143 is released, restoring an elastic force provided by the spring 143. Consequently, the pressing of the heating roller 131 against the pressure roller 133 is released, separating the heating roller 131 from the pressure roller 133 as illustrated in FIG. 5B.

Figure 6A:
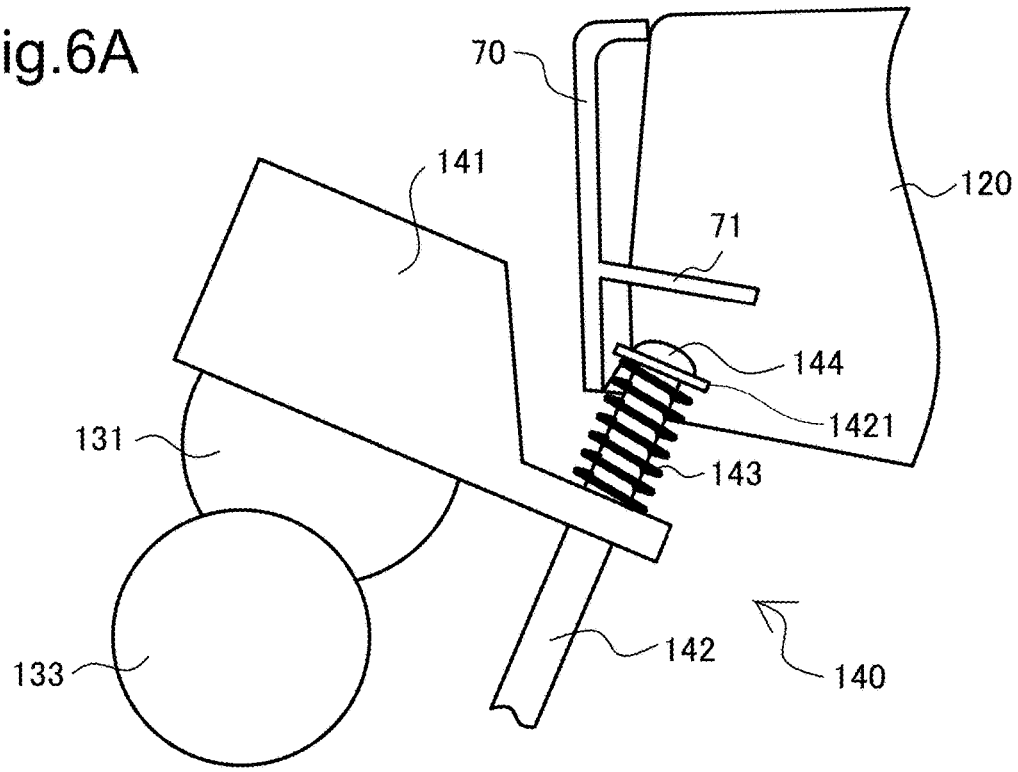
FIG. 6A is a side view schematically illustrating the cooling duct and surrounding parts thereof, in the first state in which the cooling duct is not open towards the fixing unit.
Figure 6B:
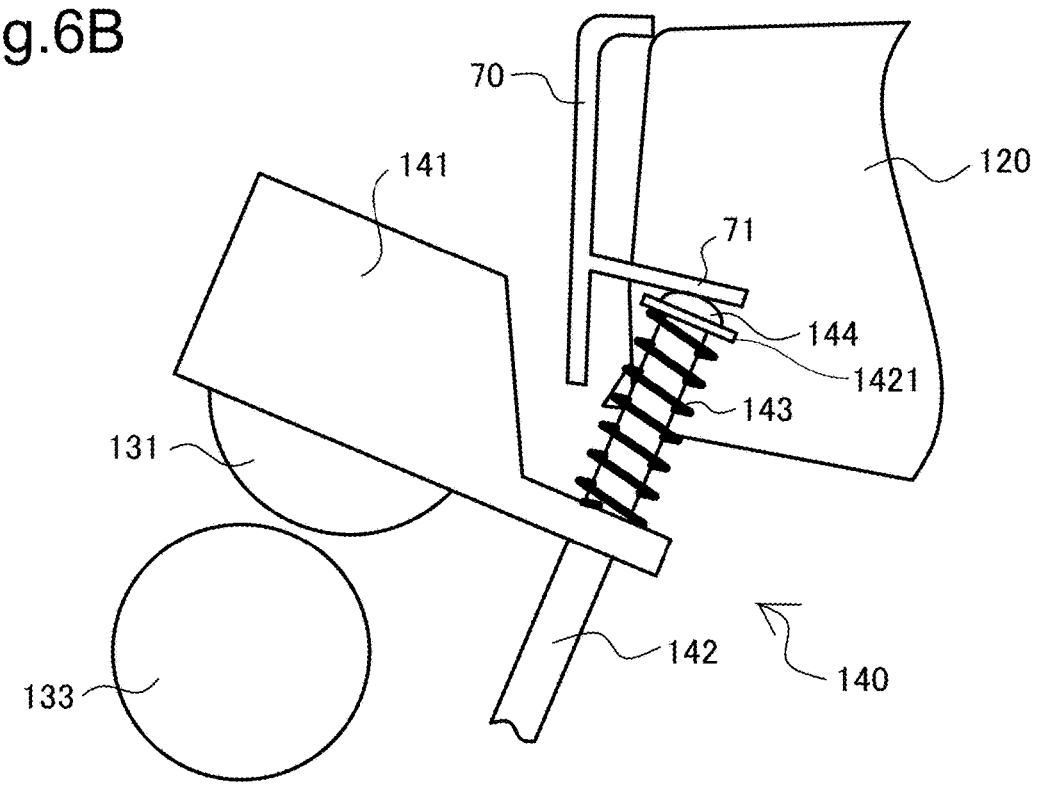
FIG. 6B is a side view schematically illustrating the cooling duct and the surrounding parts thereof, in the second state in which the cooling duct is open towards the fixing unit.

FIGS. 6A and 6B are side views schematically illustrating the cooling duct 70 and a surrounding part thereof. FIG. 6A illustrates the first state in which the cooling duct 70 is not open towards the fixing unit 130. FIG. 6B illustrates the second state in which the cooling duct 70 is open towards the fixing unit 130. Provided on an inner wall of the cooling duct 70 at positions opposing the end parts 144 of the towing shafts 142 forming the pressing and separating mechanism 140 is a pair of extension plates 71 which extends towards the drum unit 120.

As illustrated in FIG. 6A, in a case where the towing shaft 142 is pulled downward and the end part 144 presses the spring 143, the end part 144 does not make contact with the extension plate 71, setting the cooling duct 70 in the first state in which the cooling duct 70 is not open towards the fixing unit 130.

On the other hand, in a case where the towing shaft 142 is pushed upward and the pressing of the end part 144 against the spring 143 is released as illustrated in FIG. 6B, the end part 144 makes contact with the extension plate 71 and the towing shaft 142 pushes the cooling duct 70 upward by a pressing force of the spring 143, setting the cooling duct 70 in the second state in which the cooling duct 70 is open towards the fixing unit 130. That is, the cooling duct 70 changes from the first state to the second state in conjunction with operation of the pressing and separating mechanism 140.

Figure 7:
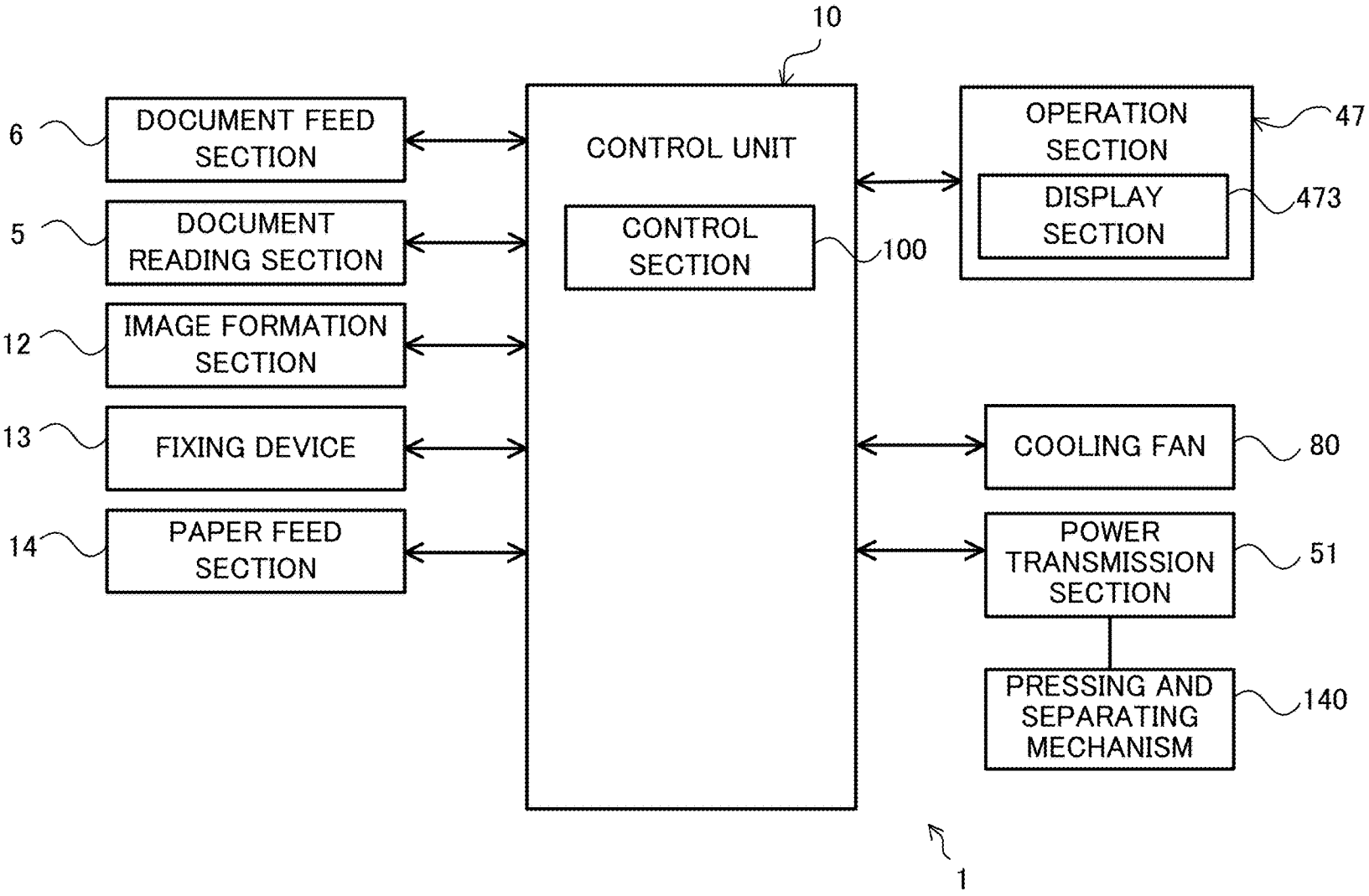
FIG. 7 is a functional block diagram schematically illustrating main inner configuration of the image forming apparatus according to the first embodiment.

FIG. 7 is a functional block diagram schematically illustrating main inner configuration of the image forming apparatus 1 according to the first embodiment. The image forming apparatus 1 includes: a control unit 10, a document feed section 6, a document reading section 5, the image formation section 12, the fixing device 13, a paper feed section 14, an operation section 47, the cooling fan 80, a power transmission section 51, and the pressing and separating mechanism 140.

A case where document reading operation is performed in the image forming apparatus 1 will be described. The document reading section 5 optically reads an image of a document conveyed by the document feed section 6 or a document loaded on platen glass to generate image data. The image data generated by the document reading section 5 is saved into, for example, an image memory.

A case where image formation operation is performed in the image forming apparatus 1 will be described. Based on, for example, the image data generated through the document reading operation or image data received from a computer serving as an external device connected to a network, the image formation section 12 forms an image on recording paper serving as a recording medium fed from the paper feed section 14.

The fixing device 13 fixes the toner image on the recording paper through the thermocompression as described above, and the recording paper subjected to fixation processing is discharged onto a discharge tray. The paper feed section 14 includes a paper feed cassette.

The operation section 47 receives, from an operator, instructions such as an image formation operation execution instruction for various operation and processing executable by the image forming apparatus 1. The operation section 47 includes a display section 473 which displays, for example, an operation guide to the operator.

The power transmission section 51 is composed of: a motor, a gear, the eccentric cam, a driver, etc., and, for example, plays a role as a driving source which converts a rotational driving force to provide the pressing and separating mechanism 140 with a linear driving force. Note that the power transmission section 51 is configured as described above in this embodiment, but the power transmission section 51 may be a solenoid serving as a driving source which provides the pressing and separating mechanism 140 with a linear driving force. The power transmission section 51 controls driving of the motor in accordance with the instruction provided from a control section 100 (to be described later on) of the control unit 10. The motor is, for example, a driving source which rotates the aforementioned eccentric cam via the aforementioned gear. A circumferential surface of the eccentric cam is provided in contact with the another end part of the towing shaft 142 opposite to the end part 144 of the towing shaft 142. Through this rotation of the eccentric cam, this another end part of the towing shaft 142 is pressed or this pressing is released. Consequently, the towing shaft 142 moves towards the pressure roller 133 (downward in FIG. 5A), or moves towards the heating roller 131 (upward in FIG. 5A).

The control unit 10 includes: a processor, a random access memory (RAM), a read only memory (ROM), and a dedicated hardware circuit. The processor is, for example, any of a central processing unit (CPU), an application specific integrated circuit (ASIC), a micro processing unit (MPU), etc. The control unit 10 includes the control section 100.

The control unit 10 functions as the control section 100 through operation performed by the aforementioned processor in accordance with a control program stored in an HDD (not illustrated). However, it is also possible to form the control section 100 with a hardware circuit without depending on the operation performed in accordance with the control program by the control unit 10. Hereinafter, the same applies to each of embodiments unless otherwise specified.

The control section 100 is in charge of overall operation control of the image forming apparatus 1. The control section 100 is connected to the document feed section 6, the document reading section 5, the image formation section 12, the fixing device 13, the paper feed section 14, the operation section 47, the cooling fan 80, and the power transmission section 51, and performs, for example, driving control of each of these sections.

The control section 100 causes the pressing and separating mechanism 140 to perform operation of pressing the heating roller 131 against the pressure roller 133 during image formation processing and separating the heating roller 131 from the pressure roller 133 after the image formation processing.

The control section 100 receives, for example, the printing instruction from the user via the operation section 47, and upon start of the image formation processing, controls the operation of the pressing and separating mechanism 140 to press the heating roller 131 against the pressure roller 133 via the power transmission section 51 and also activate the cooling fan 80.

Moreover, upon ending of the image formation processing, the control section 100 controls the operation of the pressing and separating mechanism 140 via the power transmission section 51 to separate the heating roller 131 from the pressure roller 133 and then stop the activation of the cooling fan 80 at timing of determination that a predetermined cooling fan stop condition has been established.

The cooling fan stop condition includes, for example, a temperature decrease of the heating roller 131 to a predetermined temperature. Note that information on the temperature of the heating roller 131 is acquired from a temperature sensor, not illustrated, which is arranged near the heating roller 131.

Even when heating of the fixing device (for example, the heating roller) has ended after the ending of the image formation processing, the fixing device is not immediately cooled. Thus, to prevent a temperature increase of the drum unit, it is required to keep the cooling fan activated for a while after the ending of the image formation processing. However, in terms of energy saving, it is preferable that time for which the cooling fan is activated is short.

According to the first embodiment described above, when a temperature decrease of the fixing unit 130 is not permitted (during the image formation processing), the cooling wind from the cooling fan 80 does not flow towards the fixing unit 130, while the cooling wind from the cooling fan 80 flows towards the fixing unit 130 when the temperature decrease of the fixing unit 130 is permitted (after the image formation processing). That is, when the temperature decreases of the fixing unit 130 is permitted, the fixing unit 130 is cooled directly.

Therefore, an amount of heat transferred to the drum unit 120 can be reduced without interfering with operation of the fixing unit 130, and thus a temperature increase of the drum unit 120 can efficiently be prevented, making it possible to shorten the time for which the cooling fan 80 is activated.

Note that the embodiment has been described above, referring to a case where the cooling duct 70 is changed to the first state or the second state in conjunction with the operation of the pressing and separating mechanism 140, but operation serving as a basis for the conjunction is not limited to the operation of the pressing and separating mechanism 140.

The pressing and separating mechanism 140 is one example of an adjustment mechanism which adjusts a fixing nip pressure generated at the fixing nip part N2, but the cooling duct 70 may be changed to the first state or the second state in conjunction with operation of another adjustment mechanism. Examples of this another adjustment mechanism include: a pressing and separating mechanism of pressing and separating the pressure roller 133 against and from the heating roller 131 and an adjustment mechanism of adjusting a force of pressing the heating roller 131 against the pressure roller 133.

As another embodiment, instead of causing the aforementioned opening and non-opening operation of the cooling duct 70 to be in conjunction with the operation of, for example, the pressing and separating mechanism 140, the cooling duct 70 may be provided with a new dedicated mechanism (for example, a mechanism formed of, for example, a solenoid) for causing the aforementioned opening and non-opening operation so that the control section 100 can control operation of this dedicated mechanism.

Figure 8A:
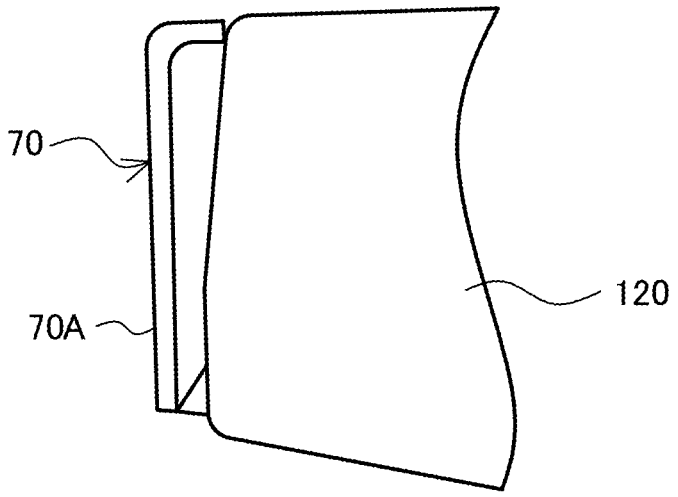
FIG. 8A is a view illustrating the first state in which the cooling duct is not open towards the fixing unit.
Figure 8B:
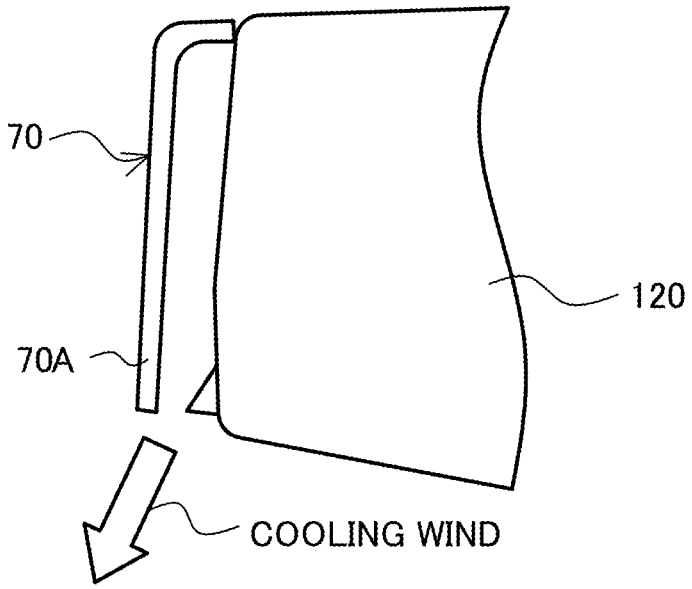
FIG. 8B is a view illustrating the second state in which the cooling duct is open towards the fixing unit.

As still another embodiment, the cooling duct 70 may be formed by using a shape-memory alloy which is deformable through a temperature change, so that, at a predetermined temperature or higher, a lower end part 70A of the cooling duct 70 is closed as illustrated in FIG. 8A, causing a change to the first state in which the cooling duct 70 is not open towards the fixing unit 130, and at a temperature less than the predetermined temperature, the lower end part 70A of the cooling duct 70 opens as illustrated in FIG. 8B, causing a change to the second state in which the cooling duct 70 is open towards the fixing unit 130. Note that the predetermined temperature is a temperature at which it can be recognized that the image formation processing has ended, and is set at, for example, a value lower than a fixing temperature by a given temperature (for example, when the fixing temperature is 180° C., this given temperature is 80° C. and the predetermined temperature is 100° C.).

For example, in a case where the predetermined temperature is set at 100° C., the heating roller 131 is heated to start the image formation processing, and when a temperature near the cooling duct 70 has increased to reach 100° C. or higher, the lower end part 70A of the cooling duct 70 is closed and the cooling duct 70 changes to the first state in which the cooling duct 70 is not open towards the fixing unit 130. On the other hand, when the temperature near the cooling duct 70 has decreased to reach a temperature less than 100° C. as a result of ending of the image formation processing and stopping of the heating of the heating roller 131, the lower end part 70A of the cooling duct 70 opens, changing the cooling duct 70 to the second state in which the cooling duct 70 is open towards the 130.

This disclosure is not limited to the configuration of the embodiments described above and thus various modifications thereto are permitted. In addition, the embodiments described above refer to a multifunction peripheral as one embodiment of the image forming apparatus according to this disclosure, but this is only one example, and may be a different image forming apparatus such as, for example, a copy machine, a printer, or a facsimile.

Moreover, the aforementioned configuration and processing indicated in the above embodiments with reference to FIGS. 1 to 8 form just one embodiment and it is not intended to limit this disclosure to the aforementioned configuration and processing in any way.

While the present disclosure has been described in detail with reference to the embodiments thereof, it would be apparent to those skilled in the art the various changes and modifications may be made therein within the scope defined by the appended claims.

What is claimed is:

1. An image forming apparatus comprising:

a drum unit having an image carrier carrying a toner image;

a fixing unit having a heating member and a pressure member forming a fixing nip part with the heating member, the fixing unit fixing the toner image on a recording medium at the fixing nip part;

a cooling duct being provided between the drum unit and the fixing unit so as to extend along longitudinally of the heating member;

a cooling fan being provided at a position located on a line extended longitudinally of the cooling duct and causing air to flow toward the cooling duct:

a pressing and separating mechanism pressing the heating member against the pressure member or separating the heating member from the pressure member; and a control section causing the pressing and separating mechanism to perform operation of pressing the heating member against the pressure member during the image formation processing and separating the heating member from the pressure member after the image formation processing, wherein the cooling duct is a movable duct being capable of changing to a first state in which the cooling duct is not open towards the fixing unit and a second state in which the cooling duct is open towards the fixing unit, the cooling duct changes to the first state during image formation processing performed by the drum unit and changes to the second state after the image formation processing, the drum unit includes a cleaning device including: a cleaning roller and a cleaning blade removing a toner from a surface of the image carrier; and a cleaning housing holding the cleaning roller and the cleaning blade, the cooling duct is provided on an outer wall of the cleaning housing, under control performed by the control section, the pressing and separating mechanism changes the cooling duct to the second state upon performing the operation of separating the heating member from the pressure member after the image formation processing, and changes the cooling duct to the first state upon performing the operation of pressing the heating member against the pressure member during the image formation processing, the pressing and separating mechanism includes: an oscillation holder supporting the heating member; a towing shaft being movably penetrated through the oscillation holder; and a spring being provided, under a state where the towing shaft is penetrated through an inside of the spring, between an armor part projecting radially from a circumferential surface part of an end part of the towing shaft and the oscillation holder, the pressing of the heating member against the pressure member is adjusted by a force of pressing of the spring against the oscillation holder, an inner wall of the cooling duct is provided with an extension plate located at a position opposite to the end part of the towing shaft, and in a case where the end part presses the spring and does not make contact with the extension plate, the cooling duct changes to the first state, and in a case where the pressing of the end part against the spring is released and thus the end part makes contact with the extension plate, the cooling duct changes to the second state.

2. The image forming apparatus according to claim 1, further comprising a control section controlling operation of the cooling fan, wherein the control section activates the cooling fan upon starting of the image formation processing by the drum unit, and stops the activation of the cooling fan upon establishment of a predetermined condition after ending of the image formation processing.

3. The image forming apparatus according to claim 2, wherein the control section stops the activation of the cooling fan when a temperature of the heating member has decreased to a predetermined temperature after the ending of the image formation processing.

4. The image forming apparatus according to claim 1, further comprising:

a power transmission section providing the pressing and separating mechanism with a driving force for moving the towing shaft; and a control section, wherein the control section controls the provision of the driving source by the power transmission section to control the movement of the towing shaft, adjusting the force of the pressing of the spring against the oscillation holder.

5. An image forming apparatus comprising:

a drum unit having an image carrier carrying a toner image;

a fixing unit having a heating member and a pressure member forming a fixing nip part with the heating member, the fixing unit fixing the toner image on a recording medium at the fixing nip part;

a cooling duct being provided between the drum unit and the fixing unit preventing heat transfer from the fixing unit to the drum unit;

a cooling fan causing the air to flow to the cooling duct, and a pressing and separating mechanism pressing the heating member against the pressure member or separating the heating member from the pressure member, wherein the cooling duct is a movable duct being capable of changing to a first state in which the cooling duct is not open towards the fixing unit and a second state in which the cooling duct is open towards the fixing unit, and the cooling duct changes to the first state during image formation processing performed by the drum unit and changes to the second state after the image formation processing, the pressing and separating mechanism includes: an oscillation holder supporting the heating member; a towing shaft being movably penetrated through the oscillation holder; and a spring being provided, under a state where the towing shaft is penetrated through an inside of the spring, between an armor part projecting radially from a circumferential surface part of an end part of the towing shaft and the oscillation holder, an inner wall of the cooling duct is provided with an extension plate located at a position opposite to the end part of the towing shaft, and in a case where the end part presses the spring and does not make contact with the extension plate, the cooling duct changes to the first state, and in a case where the pressing of the end part against the spring is released and thus the end part makes contact with the extension plate, the cooling duct changes to the second state.

6. The image forming apparatus according to claim 5, further comprising a control section, by adjusting a force of pressing of the spring against the oscillation holder, causing the heating member to press against the pressure member during the image formation processing and also causing the cooling duct to change to the first state, and causing the heating member to separate from the pressure member after the image formation processing and also causing the cooling duct to change to the second state.

* * * * *